US007928840B2

(12) United States Patent
Kim et al.

(10) Patent No.: US 7,928,840 B2
(45) Date of Patent: Apr. 19, 2011

(54) METHOD AND SYSTEM FOR PREVENTING LOSS OR THEFT USING WIRELESS PAN OR LAN

(75) Inventors: Sun-Jin Kim, Daejeon (KR); Junghae Seo, Daejeon (KR); Sun-Joong Kim, Daejeon (KR); Cheol Sig Pyo, Daejeon (KR); Jong-Suk Chae, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 382 days.

(21) Appl. No.: 12/062,120

(22) Filed: Apr. 3, 2008

(65) Prior Publication Data

US 2009/0135012 A1 May 28, 2009

(30) Foreign Application Priority Data

Nov. 26, 2007 (KR) ..... 10-2007-0120804

(51) Int. Cl.
*G08B 1/00* (2006.01)

(52) U.S. Cl. ..... 340/531; 340/539.22; 340/568.1; 340/572.4

(58) Field of Classification Search ..... 340/531, 340/539.1, 539.13, 539.22, 539.26, 568.1, 340/572.1, 572.4, 825.49, 666, 552; 455/404.2, 455/456.1, 457

See application file for complete search history.

(56) References Cited

U.S. PATENT DOCUMENTS

| | | | | |
|---|---|---|---|---|
| 6,300,875 | B1 * | 10/2001 | Schafer | 340/539.13 |
| 6,362,736 | B1 * | 3/2002 | Gehlot | 340/568.1 |
| 6,433,685 | B1 * | 8/2002 | Struble et al. | 340/571 |
| 6,631,271 | B1 * | 10/2003 | Logan | 455/456.1 |
| 7,468,659 | B2 * | 12/2008 | Haave et al. | 340/539.13 |
| 7,573,382 | B2 * | 8/2009 | Choubey et al. | 340/539.13 |
| 2006/0028352 | A1 * | 2/2006 | McNamara et al. | 340/825.49 |

FOREIGN PATENT DOCUMENTS

| | | |
|---|---|---|
| JP | 2003-141650 | 5/2003 |
| JP | 2006-309527 | 11/2006 |
| KR | 10-2006-0132300 | 12/2006 |

* cited by examiner

*Primary Examiner* — Thomas J Mullen

(74) *Attorney, Agent, or Firm* — Kile Park Goekjian Reed & McManus PLLC

(57) ABSTRACT

A method and system of preventing a loss/theft of a surveillance target including a mobile device using a wireless personal area network (PAN) or a wireless local area network (LAN) which can receive, from the mobile device included in the surveillance target via a gateway, location information of the surveillance target generated by using mobile device information for the surveillance target, the mobile device information being collected by a sensor of the mobile device, and signal information communicated between the mobile device and a fixed device, can determine whether there is a loss or theft by comparing surveillance target information and a permission standard, and can provide alert information including the location information of the surveillance target when the loss or theft occurs.

16 Claims, 3 Drawing Sheets

METHOD AND SYSTEM FOR PREVENTING LOSS OR THEFT USING WIRELESS PAN OR LAN

CROSS-REFERENCE TO RELATED APPLICATION

This application claims priority from Korean Patent Application No. 10-2007-0120804, filed on Nov. 26, 2007, in the Korean Intellectual Property Office, the entire disclosure of which is incorporated herein by reference.

BACKGROUND OF THE INVENTION

1. Field of the Invention

The present invention relates to a method and system of preventing a loss/theft using a wireless personal area network (PAN) or a wireless local area network (LAN) which can receive via a gateway, the location information of the surveillance target generated by using mobile device information for the surveillance target from a mobile device included in a surveillance target, the mobile device information being collected by a sensor of the mobile device, and signal information communicated between the mobile device and a fixed device, can determine whether there is a loss or theft by comparing the collected information about the surveillance target and a permission standard, and can provide alert information including the location information of the surveillance target when the loss or theft occurs.

This work was supported by the IT R&D program of MIC/IITA [2005-S-038-03, Development of UHF RF-ID and Ubiquitous Networking Technology].

2. Description of Related Art

Currently, an indoor theft prevention system for a surveillance target, for example in a store, uses a method of installing a surveillance camera in a dead zone that may not be seen by a user, or sensing, by adhering an identification tag to the surveillance target and including a reader recognizing the tag at an entrance to the outside, that a product to which the identification tag is adhered is moved outside.

However, the above-described method may not perform surveillance in a place where a photograph may not be taken by the camera, and may not prevent a theft when the identification tag adhered to the product is separated from the product. Also, since current general theft prevention systems may not perform surveillance of a stolen product when the surveillance target leaves a specific area, the current general theft prevention systems are disadvantageous when associated surveillance is necessary.

SUMMARY OF THE INVENTION

An aspect of the present invention provides a method and system of preventing a loss/theft using a wireless personal area network (PAN) or a wireless local area network (LAN) which can receive, from a mobile device included in a surveillance target via a gateway, a location information of the surveillance target generated by using mobile device information for the surveillance target, the mobile device information being collected by a sensor of the mobile device, and signal information communicated between the mobile device and a fixed device, can determine whether there is a loss or theft by comparing surveillance target information and a permission standard, and provide alert information including the location information of the surveillance target when the loss or theft occurs.

Another aspect of the present invention also provides a method and system of preventing a loss/theft using a wireless PAN or a wireless LAN which can efficiently perform associated surveillance between a plurality of individual networks for a surveillance target.

According to an aspect of the present invention, there is provided a method of preventing a loss/theft using a wireless PAN or a wireless LAN, the method including: receiving, from a mobile device included in a surveillance target via a gateway, a location information of the surveillance target generated by using mobile device information for the surveillance target, the mobile device information being collected by a sensor of the mobile device, and signal information communicated between the mobile device and a fixed device; determining whether there is a loss or theft by comparing surveillance target information generated using previous location information of the surveillance target from a database and the received location information of the surveillance target, and a permission standard associated with the surveillance target from a database; and providing a pre-registered terminal with alert information including the location information of the surveillance target when it is determined that the loss or theft occurs.

According to another aspect of the present invention, there is provided a system for preventing a loss/theft using a wireless PAN or a wireless LAN, the system including: an interface unit to receive, from a mobile device included in a surveillance target via a gateway, location information of the surveillance target generated by using mobile device information for the surveillance target, the mobile device information being collected by a sensor of the mobile device, and signal information communicated between the mobile device and a fixed device; a determination unit to determine whether there is a loss or theft by comparing surveillance target information generated using previous location information of the surveillance target and the received location information of the surveillance target, and a permission standard associated with the surveillance target, the previous location information and the permission standard being extracted from a database; and a location information providing unit to provide a pre-registered terminal with alert information including the location information of the surveillance target when it is determined that the loss or theft occurs.

BRIEF DESCRIPTION OF THE DRAWINGS

The above and other aspects of the present invention will become apparent and more readily appreciated from the following detailed description of certain exemplary embodiments of the invention, taken in conjunction with the accompanying drawings of which.

DETAILED DESCRIPTION OF EXEMPLARY EMBODIMENTS

Figure 1:
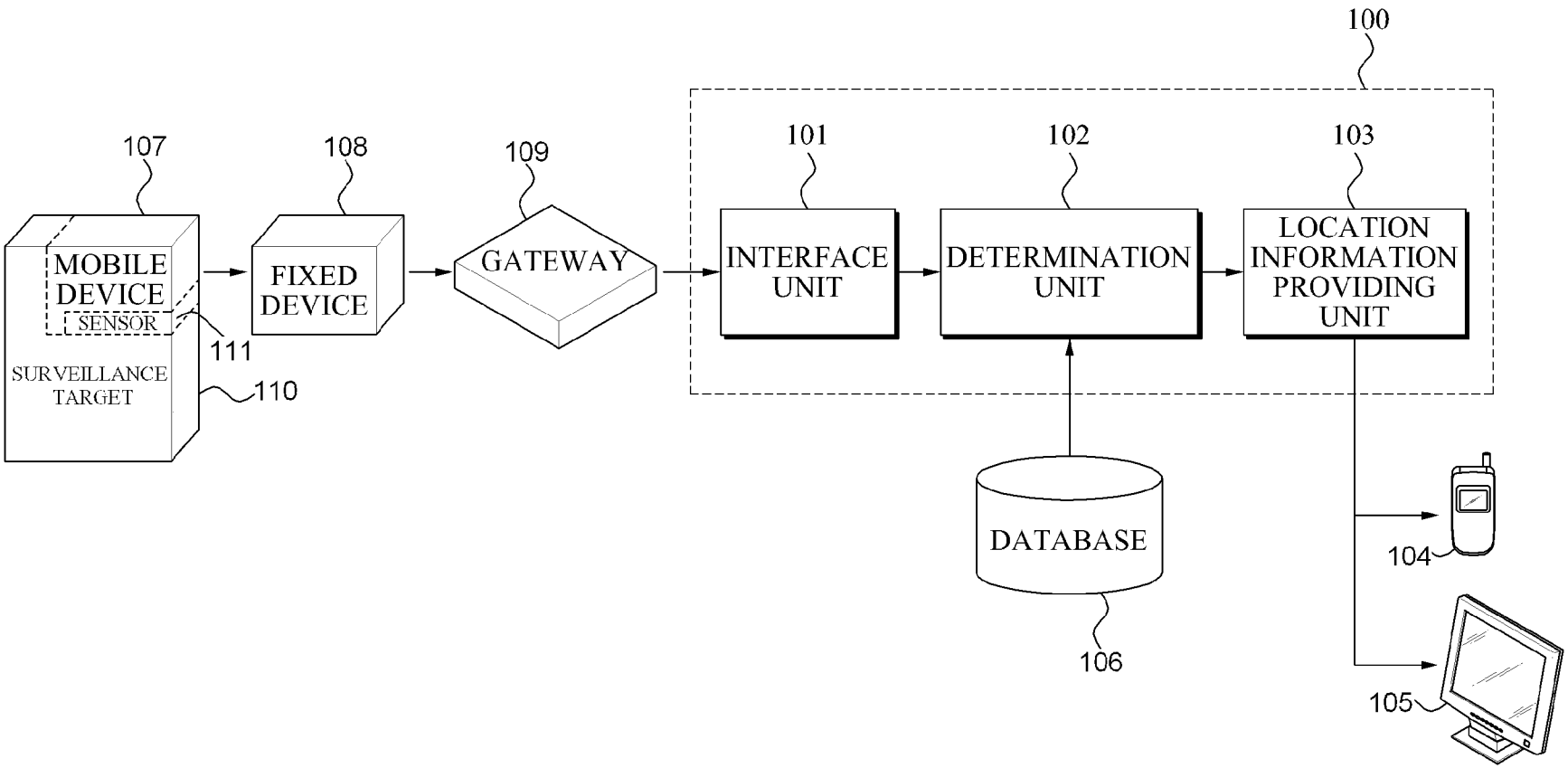
FIG. 1 illustrates a configuration of a system for preventing a loss/theft using a wireless personal area network (PAN) or a wireless local area network (LAN) according to an exemplary embodiment of the present invention.

Reference will now be made in detail to exemplary embodiments of the present invention, examples of which are illustrated in the accompanying drawings, wherein like reference numerals refer to the like elements throughout. The exemplary embodiments are described below in order to explain the present invention by referring to the figures.

FIG. 1 illustrates a configuration of a system 100 for preventing a loss/theft using a wireless personal area network (PAN) or a wireless local area network (LAN) according to an exemplary embodiment of the present invention.

Referring to FIG. 1, the system 100 for preventing the loss/theft using the wireless PAN or the wireless LAN includes an interface unit 101, a determination unit 102, and a location information providing unit 103.

The interface unit 101 receives, from a mobile device 107 included in a surveillance target 110 via a gateway 109, a location information of the surveillance target generated by using mobile device information for the surveillance target, the mobile device information being collected by a sensor 111 of the mobile device, and signal information communicated between the mobile device and a fixed device 108.

In this instance, the fixed device 108 is fixed in the space in which the surveillance target 110 is located. Also, the mobile device 107 and the fixed device 108 communicate with each other. The mobile device 107 may communicate with another mobile device, and the fixed device 108 may communicate with another fixed device.

The gateway 109 may store network information of the mobile device 107 and the fixed device 108.

Specifically, the interface unit 101 receives, from the mobile device 107 included in the surveillance target via the gateway 109, an identifier of the surveillance target and the location information of the surveillance target generated using the mobile device information being collected by the sensor 111 of the mobile device including at least one of movement information, weight information, and vibration information of the surveillance target, and the signal information communicated between the mobile device 107 and the fixed device 108.

Also, the interface unit 101 receives, via the fixed device 108 and the gateway 109, the mobile device information, an identifier of the mobile device, the signal information communicated between the mobile device 107 and the fixed device 108, and an identifier of the fixed device.

The determination unit 102 determines whether there is a loss or theft by comparing surveillance target information generated using previous location information of the surveillance target and the received location information of the surveillance target, and a permission standard associated with the surveillance target, the previous location information and the permission standard being extracted from a database 106. Specifically, when an identifier of the surveillance target is received, the determination unit 102 calculates a distance from the received location information of the surveillance target to a previous location information of the surveillance target, the previous location being extracted from the database 106 according to the received identifier, and determines whether a loss or theft has occurred by comparing the calculated distance and the permitted distance criterion (or permission standard) associated with the surveillance target, the permitted distance criterion being extracted from the database 106 according to the received identifier.

The location information providing unit 103 provides a pre-registered terminal 104 or display device 105 with alert information including the location information of the surveillance target when it is determined that there is the loss or theft.

Also, the location information providing unit 103 performs associated surveillance by sharing, with other gateways, the identifier of the mobile device, the identifier of the fixed device, and the network information when the surveillance target moves to a section managed by another gateway.

Also, the location information providing unit 103 displays and provides the alert information based on a specification or other specified display format or alert format of the terminal.

Also, the location information providing unit 103 provides the location information of the surveillance target to the terminal when a request for the location information of the surveillance target is received from the terminal.

Hereinafter, a system 200 for preventing a loss/theft using a wireless PAN or a wireless LAN according to an exemplary embodiment of the present invention is described with reference to FIG. 2.

Figure 2:
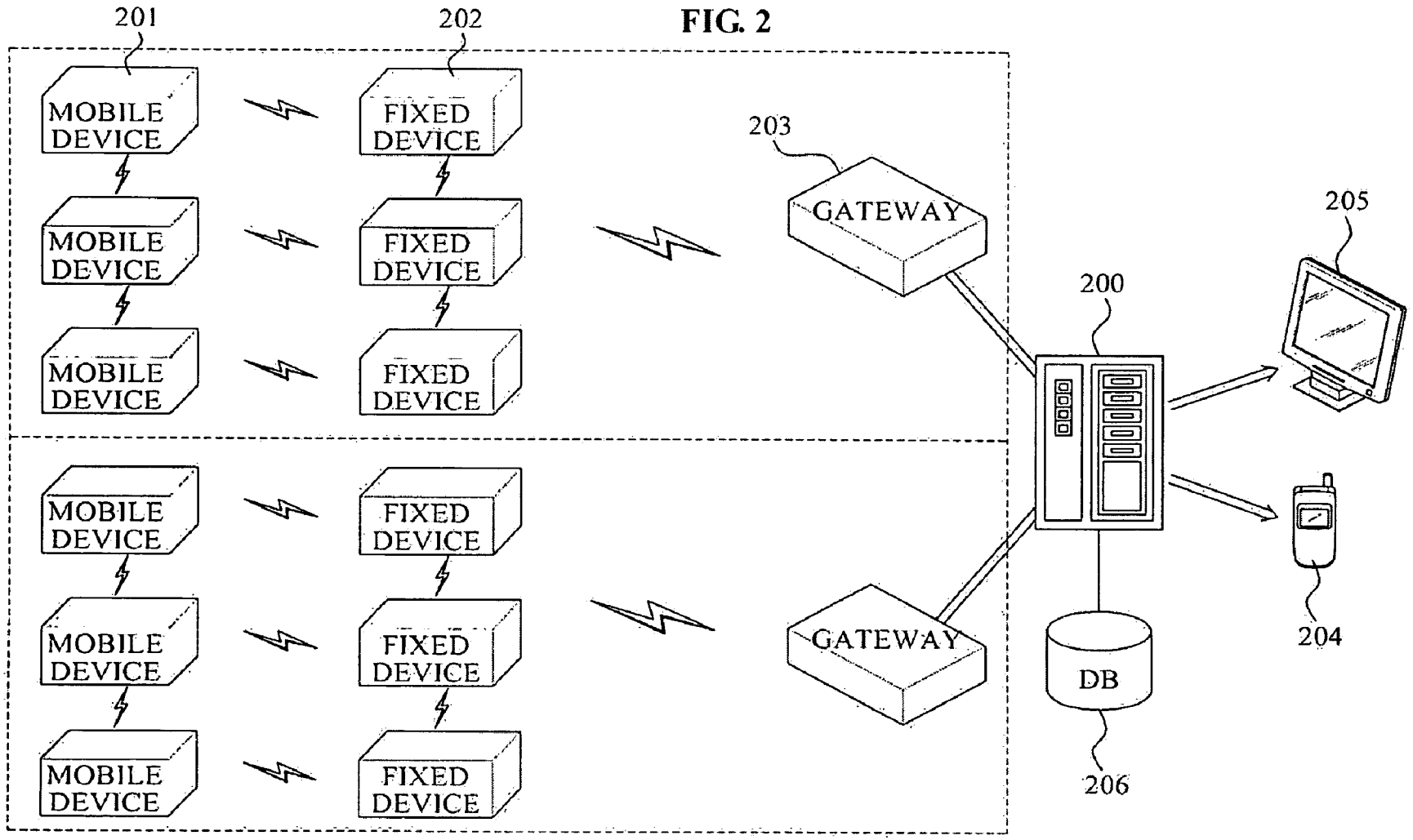
FIG. 2 illustrates a system for preventing a loss/theft using a wireless PAN or a wireless LAN according to an exemplary embodiment of the present invention.

FIG. 2 illustrates the system 200 for preventing the loss/theft using the wireless PAN or the wireless LAN according to the present exemplary embodiment of the present invention.

As illustrated in FIG. 2, the system 200 for preventing the loss/theft receives from a gateway 203, mobile device information and signal information communicated between a mobile device 201 and a fixed device 202, determines whether there is a loss or theft, and provides alert information including location information to a short-distance or long-distance user terminal 204 via a wireless network or a wired network. The above-described system 200 for preventing the loss/theft needs a mobile device 201, a fixed device 202, a gateway 203, and a database 206, which respectively substantially correspond to the mobile device 107, fixed device 108, gateway 109, and database 106 of system 100 shown in FIG. 1. In this instance, the system 200 for preventing the loss/theft may display the alert information including the location information using a display device 205.

The mobile device 201 included in a surveillance target located indoors collects the mobile device information including at least one of movement information, vibration information, and weight information of the surveillance target by using its own motion sensor, its own vibration sensor, or its own weight sensor, and outputs the collected mobile device information to the fixed device 202 as signal information.

The fixed device 202 is included in a fixed location in space in which the mobile device 201 is located, receives the mobile device information transmitted from the mobile device 201, and outputs the mobile device information. Also, the fixed device 202 provides the signal information communicated between the mobile device and the fixed device, the mobile device information, an identifier of the mobile device, and an identifier of the fixed device for the system 200 for preventing the loss/theft.

The gateway 203 generates the location information of the surveillance target from the mobile device information provided from the fixed device 202 and the signal information communicated between the mobile device and the fixed device, transmits the location information of the surveillance target to the system 200 for preventing the loss/theft, and stores/manages network information of the mobile device associated with the surveillance target and of the fixed device.

The database 206 stores and manages history information received from the system 200 for preventing the loss/theft and the gateway 203.

The mobile device 201 may include the vibration sensor, the motion sensor, or the weight sensor that may sense changes of a movement, a vibration, and a weight of the surveillance target, and transmits the mobile device information collected by the sensors to the fixed device 202 using the wireless PAN or the wireless LAN. In this instance, the fixed device 202 may identify the mobile device 201 denoted by the above-described identifier from among a plurality of mobile devices by transmitting the mobile device information and the identifier of the mobile device 201.

The fixed device 202 receives the mobile device information and the identifier of the mobile device transmitted from the plurality of mobile devices composing a network, and transmits the mobile device information and the identifier of the mobile device to the gateway 203. The fixed device 202 may be embodied as a wireless access point that wirelessly transceives data to/from the mobile device 201 using a wireless communication protocol such as Radio Frequency (RF), Bluetooth, and Zigbee, but is not limited thereto.

The gateway 203 receives the mobile device information of the plurality of mobile devices and the identifier of the mobile device transmitted from the fixed device 202, the signal information communicated between the mobile device and the fixed device, and the identifier of the fixed device, and stores and manages the mobile device information, the identifier of the mobile device, the signal information, and the identifier of the fixed device in its own database.

The system 200 for preventing the loss/theft provides the movement information of the corresponding surveillance targets to a mobile display or a fixed display of a user located at a short distance or a long distance via the wireless network or the wired network by using the mobile device information about the changes of the movement, the vibration, and the weight of the surveillance target provided by the corresponding mobile device 201.

The system 200 for preventing the loss/theft determines whether the loss or theft of the surveillance target has occurred by comparing the mobile device information about the changes of the movement, the vibration, and the weight of the corresponding mobile device 201, and a permission standard stored in the database 206.

When it is determined that there is a loss or theft of the surveillance target (i.e., when it is detected that a loss or theft of the surveillance target has occurred), the system 200 for preventing the loss/theft provides the alert information including the location information of the surveillance target to a user terminal or a mobile communication terminal located at a short distance or a long distance via the wireless network or the wired network. When a user terminal 204 is a mobile communication terminal, the system 200 for preventing the loss/theft may provide the location information using a text message service such as a Short Message Service (SMS) and a Multimedia Messaging System (MMS). When the user terminal is a computer, the system 200 for preventing the loss/theft may provide the location information using a service such as e-mail or using a popup window. Accordingly, a user may identify, at a long distance, the location information of the surveillance target and whether a loss or theft has occurred.

Also, the system 200 for preventing the loss/theft receives a location identification request of the surveillance target, the location identification request being transmitted from a specific terminal, and transmits the location identification request to the fixed device 202, and the fixed device 202 transmits the location identification request to the mobile device 201 classified by the identifier corresponding to the corresponding location identification request. Accordingly, the mobile device 201 transmits its own location identification information to the fixed device 202, and the system 200 for preventing the loss/theft receives the location identification information of the mobile device 201 from the fixed device 202, and provides the location identification information of the mobile device 201 to the terminal Therefore, the above-described specific terminal may identify the location information of the surveillance target.

The gateway 203 may integratedly manage a plurality of networks including a plurality of mobile devices communicating with the fixed device and with each other. Specifically, the mobile device 201 is registered in the network managed by at least one gateway and forms part of the network. When the mobile device 201 registered in a specific network moves and joins another network managed by another gateway, the system 200 for preventing the loss/theft may associatedly identify whether there is the loss or theft of the surveillance target including the mobile device 201, and the location information of the surveillance target.

Therefore, according to the present invention, there is provided a system for preventing a loss/theft using a wireless PAN or a wireless LAN which can receive, from a mobile device included in a surveillance target via a gateway, a location information of the surveillance target generated by using mobile device information for the surveillance target, the mobile device information being collected by a sensor of the mobile device, and signal information communicated between the mobile device and a fixed device, determine whether there is a loss or theft by comparing surveillance target information and a permission standard, and provide alert information including the location information of the surveillance target when there is the loss or theft.

Figure 3:
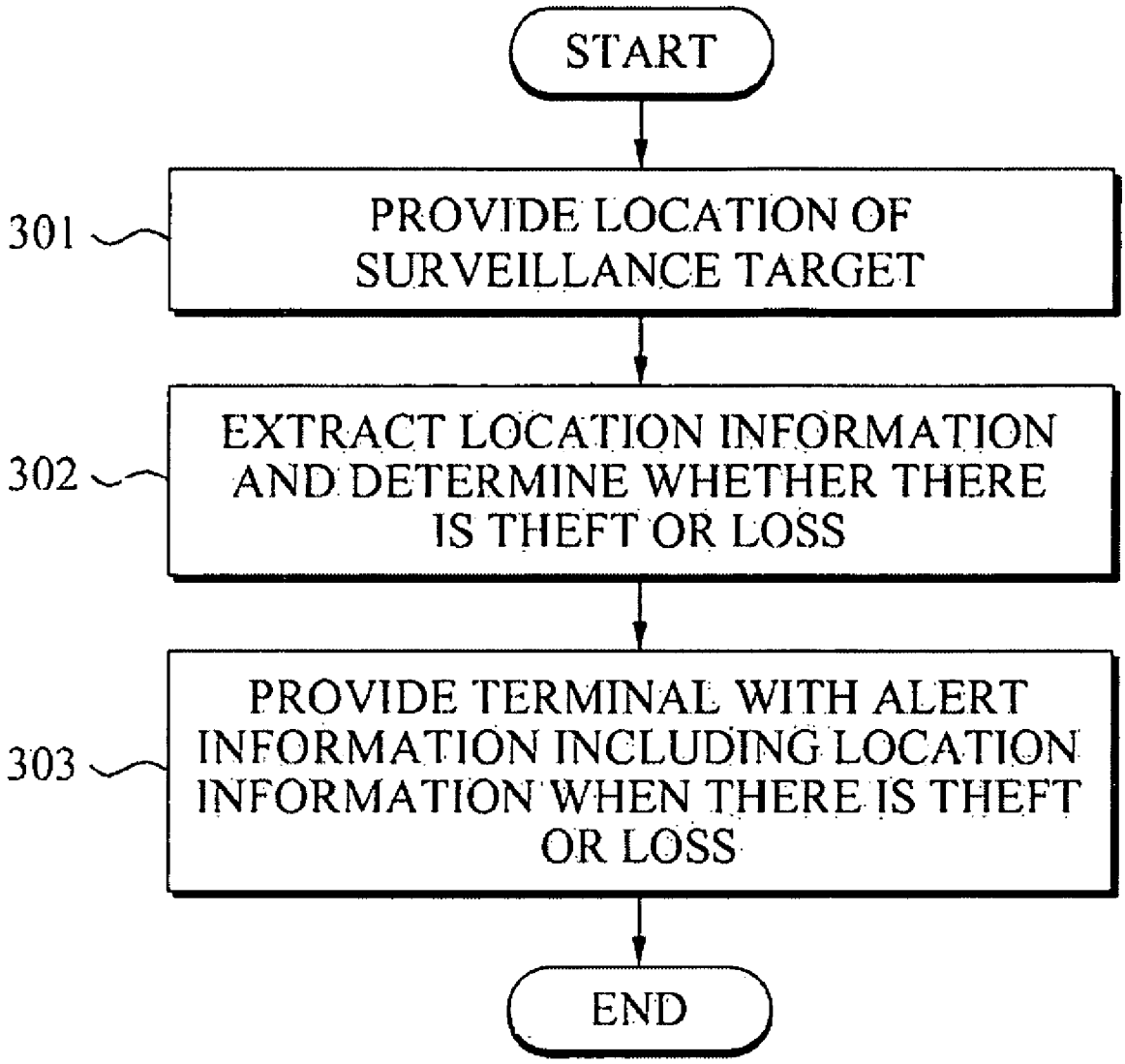
FIG. 3 is a flowchart illustrating a method of preventing a loss/theft using a wireless PAN or a wireless LAN according to an exemplary embodiment of the present invention.

FIG. 3 is a flowchart illustrating a method of preventing a loss/theft using a wireless PAN or a wireless LAN according to an exemplary embodiment of the present invention.

In operation 301, an interface unit of a system for preventing a loss/theft receives, from a mobile device included in a surveillance target via a gateway, a location information of the surveillance target generated by using mobile device information for the surveillance target, the mobile device information being collected by a sensor of the mobile device, and signal information communicated between the mobile device and a fixed device. Here, the mobile device and the fixed device communicate with each other. Also, the fixed device is fixed in space in which the surveillance target is located. Specifically, operation 301 is a process of receiving, from the mobile device included in the surveillance target via the gateway, an identifier of the surveillance target and the location information of the surveillance target generated by using the mobile device information for the surveillance target, the mobile device information being collected by the sensor of the mobile device, and the signal information communicated between the mobile device and the fixed device.

Operation 301 may include a process of receiving, via the gateway storing network information of the mobile device and the fixed device, an identifier of the mobile device and an identifier of the fixed device, and may include a process of receiving, via the fixed device and the gateway, the mobile device information, the identifier of the mobile device, the signal information communicated between the mobile device and the fixed device, and the identifier of the fixed device.

In operation 302, a determination unit of the system for preventing the loss/theft determines whether there is a loss or theft by comparing surveillance target information generated using a previous location information of the surveillance target and the received location information of the surveillance target, and a permission standard associated with the surveillance target, the previous location information and the permission standard being extracted from a database. Specifically, when the identifier of the surveillance target is received, operation 302 is a process of calculating a distance from the received location information of the surveillance target to a previous location information of the surveillance target, the previous location being extracted from the database by corresponding to the identifier, and determining whether there is the loss or theft by comparing the calculated distance and the permission standard associated with the surveillance target, the permission standard being extracted from the database by corresponding to the identifier.

In operation 303, a location information providing unit of the system for preventing the loss/theft provides a pre-registered terminal with alert information including the location information of the surveillance target when it is determined that there is the loss or theft.

In operation 303, the location information providing unit performs associated surveillance by sharing, with another gateway, the identifier of the mobile device, the identifier of the fixed device, and the network information when the surveillance target moves to a section managed by other gateways, and provides and displays the alert information based on a specification or other specified display format or alert format of the terminal. Also, the location information providing unit provides the location information of the surveillance target to the terminal when a request for the location information of the surveillance target is received from the terminal.

Therefore, according to the present invention, there is provided a method of preventing a loss/theft using a wireless PAN or a wireless LAN which can receive, from a mobile device included in a surveillance target via a gateway, a location information of the surveillance target generated by using mobile device information for the surveillance target, the mobile device information being collected by a sensor of the mobile device, and signal information communicated between the mobile device and a fixed device, can determine whether there is a loss or theft by comparing surveillance target information and a permission standard, and can provide alert information including the location information of the surveillance target when there is the loss or theft.

According to the present invention, there is provided a system and method of preventing a loss/theft using a wireless PAN or a wireless LAN which can receive, from a mobile device included in a surveillance target via a gateway, a location information of the surveillance target generated by using mobile device information for the surveillance target, the mobile device information being collected by a sensor of the mobile device, and signal information communicated between the mobile device and a fixed device, can determine whether there is a loss or theft by comparing surveillance target information and a permission standard, and can provide alert information including the location information of the surveillance target when there is the loss or theft.

Also, according to the present invention, there is provided a system and method of preventing a loss/theft using a wireless PAN or a wireless LAN which can efficiently perform associated surveillance between a plurality of individual networks for a surveillance target.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

The invention claimed is:

1. A method of preventing a loss or theft of a surveillance target including a mobile device using a wireless personal area network (PAN) or a wireless local area network (LAN), the method comprising:

receiving via a gateway, mobile device information, location information of the surveillance target, an identifier of the mobile device, and an identifier of a fixed device, wherein the mobile device information is collected by a sensor of the mobile device included in the surveillance target, from the mobile device, and includes at least one of movement information, vibration information, and weight information of the surveillance target, and the location information of the surveillance target is generated using the mobile device information and signal information communicated between the mobile device and the fixed device;

determining whether a loss or theft of the surveillance target has occurred by calculating a distance between a first location determined according to previous location information of the surveillance target, and a second location determined according to the received location information of the surveillance target, and by comparing the calculated distance with a permitted distance criterion associated with the surveillance target, wherein the previous location information and the permitted distance criterion are extracted from a database; and providing a pre-registered terminal with alert information including the received location information of the surveillance target when it is determined that the loss or theft has occurred.

2. The method of claim 1, wherein the fixed device is fixed in an area in which the surveillance target is located, and further comprising:

receiving, via the fixed device and the gateway, the mobile device information, the identifier of the mobile device, the signal information communicated between the mobile device and the fixed device, and the identifier of the fixed device.

3. The method of claim 1, wherein the mobile device and the fixed device communicate with each other.

4. The method of claim 1, wherein the receiving comprises:

receiving via the gateway an identifier of the surveillance target and the location information of the surveillance target.

5. The method of claim 1, wherein, when an identifier of the surveillance target is received, the previous location information and the permitted distance criterion are extracted from the database according to the identifier of the surveillance target.

6. The method of claim 1, further comprising:

sharing with another gateway the identifier of the mobile device, the identifier of the fixed device, and network information of the mobile device and the fixed device.

7. The method of claim 1, wherein the providing comprises:

displaying the alert information on the pre-registered terminal.

8. The method of claim 1, further comprising:

providing the location information of the surveillance target to the pre-registered terminal when a request for the location information of the surveillance target is received from the pre-registered terminal.

9. A system for preventing a loss or theft of a surveillance target including a mobile device using a wireless personal area network (PAN) or a wireless local area network (LAN), the system comprising:

an interface unit to receive, from a gateway, mobile device information, location information of the surveillance target, an identifier of the mobile device, and an identifier of a fixed device, wherein the mobile device information is collected by a sensor of the mobile device included in the surveillance target, from the mobile device, and includes at least one of movement information, vibration information, and weight information of the surveillance target, and the location information of the surveillance target is generated using the mobile device information and signal information communicated between the mobile device and the fixed device;

a determination unit to determine whether a loss or theft of the surveillance target has occurred by calculating a distance between a first location determined according previous location information of the surveillance target, and a second location determined according to the received location information of the surveillance target, and by comparing the calculated distance with a permitted distance criterion associated with the surveillance target, wherein the previous location information and the permitted distance criterion are extracted from a database; and a location information providing unit to provide a pre-registered terminal with alert information including the received location information of the surveillance target when it is determined that the loss or theft has occurred.

10. The system of claim 9, wherein the fixed device is fixed in an area in which the surveillance target is located, and the interface unit receives, via the fixed device and the gateway, the mobile device information, the identifier of the mobile device, the signal information communicated between the mobile device and the fixed device, and the identifier of the fixed device.

11. The system of claim 9, wherein the mobile device and the fixed device communicate with each other.

12. The system of claim 9, wherein the interface unit receives, from the gateway, an identifier of the surveillance target and the location information of the surveillance target.

13. The system of claim 9, wherein, when an identifier of the surveillance target is received, the previous location information and the permitted distance criterion are extracted from the database according to the identifier of the surveillance target.

14. The system of claim 9, wherein the location information providing unit shares with another gateway the identifier of the mobile device, the identifier of the fixed device, and network information of the mobile device and the fixed device.

15. The system of claim 9, wherein the location information providing unit displays the alert information on the pre-registered terminal.

16. The system of claim 9, wherein the location information providing unit provides the location information of the surveillance target to the pre-registered terminal when a request for the location information of the surveillance target is received from the pre-registered terminal.

* * * * *